US005790718A

United States Patent [19]

Tenner et al.

[11] Patent Number: 5,790,718

[45] Date of Patent: Aug. 4, 1998

[54] FOOD PORTION INVENTORY DEVICE WITH IMPRINTED PREDETERMINED DATE INDICIA

[75] Inventors: Mark Tenner, Playa del Rey; D'Shawn Kerrins, Laguna Beach, both of Calif.

[73] Assignee: Stripper Bags, Inc., Henderson, Nev.

[21] Appl. No.: 792,667

[22] Filed: Jan. 29, 1997

Related U.S. Application Data

[63] Continuation of Ser. No. 622,612, Mar. 25, 1996, Pat. No. 5,642,605, which is a continuation of Ser. No. 435,000, May 4, 1995, abandoned, which is a continuation of Ser. No. 48,114, Apr. 14, 1993, abandoned.

[51] Int. Cl.[6] ..... B65B 61/02

[52] U.S. Cl. ..... 383/127; 53/131.2; 206/459.5

[58] Field of Search ..... 53/411, 469, 131.2, 53/131.3, 131.4, 131.5; 206/459.5; 215/365; 283/55, 79, 114; 383/127; 493/187, 188

[56] References Cited

U.S. PATENT DOCUMENTS

| | | | |
|---|---|---|---|
| 1,333,374 | 3/1920 | Bates | 493/188 X |
| 2,029,340 | 2/1936 | Royal | 493/188 |
| 2,155,057 | 4/1939 | Moore | 206/459.5 |
| 3,057,473 | 10/1962 | Stern et al. | 206/459.5 X |
| 3,182,791 | 5/1965 | Jenner | 206/459.5 |
| 3,190,054 | 6/1965 | Arnold et al. | 206/459.5 X |
| 3,282,173 | 11/1966 | Davis et al. | 493/187 X |
| 3,286,005 | 11/1966 | Cook | 493/187 X |
| 3,308,722 | 3/1967 | Peterson | 493/187 |
| 3,308,962 | 3/1967 | Bryant | 206/459.5 X |
| 3,431,699 | 3/1969 | Eppenberger | 53/131.4 X |
| 3,473,286 | 10/1969 | Henry | 53/411 |
| 3,509,680 | 5/1970 | Weber | 53/411 |
| 3,765,326 | 10/1973 | Hawkins | 53/131.4 X |
| 3,773,250 | 11/1973 | Phillips | 206/459.5 |
| 3,837,104 | 9/1974 | Brotschi | 283/55 X |
| 3,954,371 | 5/1976 | Hutt et al. | 493/188 X |
| 4,039,080 | 8/1977 | Cappuccilli | 206/459.5 X |
| 4,073,117 | 2/1978 | Shenoha | 53/411 |
| 4,262,581 | 4/1981 | Ferrell | 493/188 |
| 4,344,644 | 8/1982 | Somogyi | 283/55 X |
| 4,534,468 | 8/1985 | Nuckols et al. | 206/459.5 X |
| 4,621,670 | 11/1986 | Yuen | 215/365 X |
| 4,736,849 | 4/1988 | Leonard et al. | 206/459.5 X |
| 4,749,085 | 6/1988 | Denney | 206/459.5 X |
| 4,844,509 | 7/1989 | Kaspvzak et al. | 283/114 X |
| 4,846,503 | 7/1989 | Strauss | 283/114 X |
| 4,852,910 | 8/1989 | Taffer | 283/114 X |
| 4,860,899 | 8/1989 | McKee | 206/459.5 X |

FOREIGN PATENT DOCUMENTS

| | | |
|---|---|---|
| 0494843 A1 | 1/1992 | European Pat. Off. . |
| 6407197 | 12/1968 | Netherlands . |
| 7701784 | 2/1977 | Netherlands . |
| 276247 | 2/1927 | United Kingdom . |

*Primary Examiner*—Daniel Moon

*Attorney, Agent, or Firm*—Jeffer, Mangels, Butler & Marmaro LLP

[57] ABSTRACT

A portion inventory device for holding at least one portion of food or the like. The device uses a container for holding the portions and the container has indicia of predetermined dates imprinted on the outer surfaces of the container so that a user can readily determine the day or date on which the portion was prepared and stored. The indicia of the predetermined dates may use one of a plurality of different colors to correspond to the one of the plurality of predetermined dates. Further, the indicia for the predetermined dates may be expressed in a plurality of languages or displayed in a variety of patterns and styles.

6 Claims, 1 Drawing Sheet

FOOD PORTION INVENTORY DEVICE WITH IMPRINTED PREDETERMINED DATE INDICIA

This is a continuation of application Ser. No. 08/622,612, filed on Mar. 25, 1996, now Pat. No. 5,642,605 which in turn is a continuation of applications Ser. No. 08/435,000, filed on May 4, 1995, how abandoned, which in turn is a continuation of application Ser. No. 08/048.114, filed on Apr. 14, 1993 now abandoned.

FIELD OF THE INVENTION

This invention relates to a portion inventory device and, in particular embodiments, a bag imprinted with indicia of a predetermined date to facilitate product rotation and reduce costs.

BACKGROUND OF THE INVENTION

Traditionally, restaurant food portions have been stored in plastic bags to maintain freshness once the food was divided into individual portions. The object was to prepare the food portions in advance of the actual need (i.e., normally during the slower hours of operation of the restaurant). This allowed for a more efficient use of labor. However, once the food was divided into portions, any freshness markers on the original package were lost. Thus, it became difficult to keep track of the freshness of the food portions after they were formed.

To overcome this drawback of having unmarked portions, labels were applied to the plastic bags. Labels were typically made from colored paper having an adhesive backing. To use the labels, the user had to take a label from a package and apply it to the plastic bag. This method required several steps and therefore was labor intensive. Moreover, the labels could occasionally fall off and defeat the very purpose for which they were used. Further, the use of labels was more costly, since a user had to buy both the plastic bags and the labels.

Another alternative using labels was to preprint the date on the labels. However, the user still had to buy both the plastic bags and labels. Further, the user still had to use additional labor to apply the labels and the labels could still fall off.

An alternative to the labels was to write the date directly on the plastic bag without using a label. The drawback to this approach was that expensive, special purpose pens were needed to mark the bags, so that the ink would not run or rub off. A modification to this alternative, to avoid the expensive pens, involved placing a white substance on the plastic bag to form a writing space which accepted ordinary ink. These sections, if labeled, typically recited "date" or "contents". However, this approach still required the additional labor of marking the bag at the time the portion was formed.

SUMMARY OF THE DISCLOSURE

It is an object of an embodiment of the present invention to provide an improved food portion inventory device using containers that have indicia of predetermined dates imprinted on the container and which obviates for practical purposes the above-mentioned limitations. In particular embodiments the improved containers may be bags made from materials, such as plastic, paper or the like, and indicia of the predetermined dates may be days of the week or names of the months.

According to an embodiment of the present invention, the portion inventory device is for holding at least one portion of food or the like. The device uses a container or bag for holding the portions and the container has indicia of predetermined dates imprinted on the outer surfaces of the container so that a user can readily determine the day or date the portion was prepared and stored.

In particular embodiments of the present invention, indicia of the predetermined dates may use one of a plurality of different colors to correspond to the one of the plurality of predetermined dates. Further, indicia for the predetermined dates may be expressed in a plurality of languages or displayed in a variety of patterns and styles.

Embodiments of the invention are unique to the hospitality industry and the commercialization of such embodiments will solve long felt needs.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

The detailed description of embodiments of the invention will be made with reference to the accompanying drawings, wherein like numerals designate corresponding parts in the several figures.

DETAILED DESCRIPTION OF THE DISCLOSURE

Figure 1:
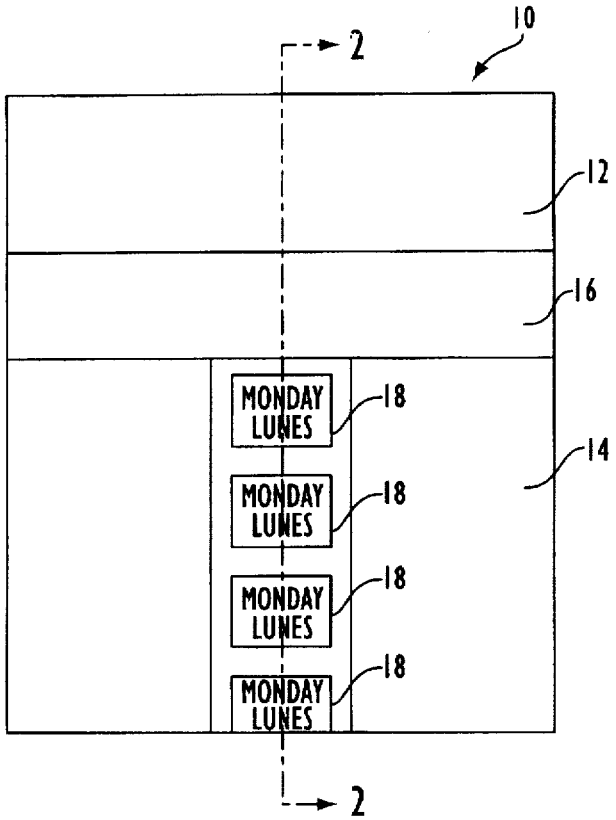
FIG. 1 is a perspective view of an embodiment of the present invention.

As shown in the drawings for purposes of illustration, the invention is embodied in a container for holding at least one portion and which has indicia of predetermined dates imprinted on the container. In preferred embodiments of the present invention, the container is a thin flexible plastic bag and indicia of the plurality of predetermined dates are the names of the week days. However, it will be recognized that further embodiments of the invention may use any suitable container for holding at least one portion or may use indicia of any predetermined dates.

FIG. 1 shows an embodiment of a portion inventory device which is comprised of a bag 10. The bag in this embodiment may be made from materials such as plastic, wax paper, paper, foil or the like. Further, the bag 10 may be either transparent for easy viewing of any enclosed portion or it may be opaque. Moreover, the bag 10 may come in a variety of sizes to accommodate a wide range of portion sizes. The device of FIG. 1 is primarily designed to hold food portions for use by a restaurant. However, it should be understood that the device may be used with any type of item for which quick date identification is important or desired.

Figure 2:
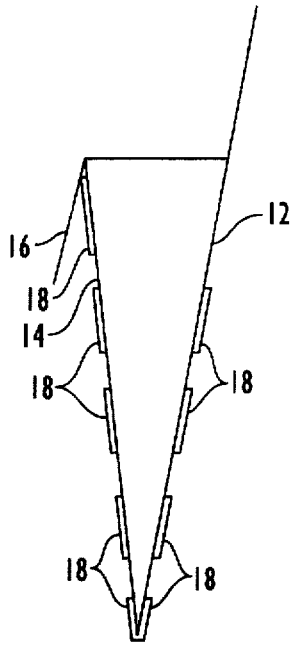
FIG. 2 is a cross-sectional view of an open state of the embodiment shown in FIG. 1 along the line 2–3.
Figure 3:
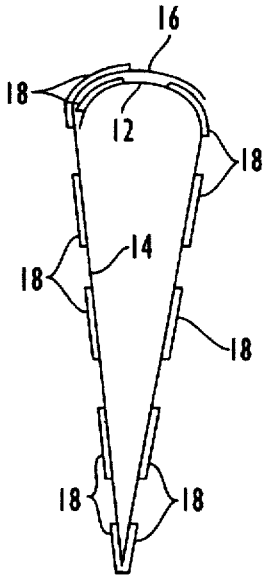
FIG. 3 is a cross-sectional view of a closed state of the embodiment shown in FIG. 1 along the line 2–3.

The bag 10 used in the embodiment of FIG. 1 is shown as being made from an opaque plastic to simplify the understanding of the illustrative drawings. The bag 10 is formed by a rear panel portion 12, a front panel portion 14 and a closure flap portion 16. FIG. 2 shows a cross-section of the bag 10 along a line 2–3 in an open state. As shown in FIG. 2, food portions (not shown) would be held inside the bag 10 between the rear panel 12 and the front panel 14. FIG. 3 shows the bag 10 of FIGS. 1 and 2 in a closed state. The bag 10 of the illustrated embodiment is closed by folding over the rear panel 12 to fit inside the bag 10, just behind the front panel 14. Next, the closure flap 16 is turned inside out to cover the top of the folded over rear panel 12. Once the closure flap 16 is in place, the food portion is held securely inside the bag 10. It should be understood that the illustrated embodiment uses a fold over closure flap system, however, the bag 10 could use a different sealing method. For example, the bag 10 could use a zipper type locking seal located at the tops of the rear panel 12 and a longer front panel 14 to close the bag 10.

As shown in FIG. 1, the bag 10 has indicia of a predetermined date 18 imprinted on the outer surface of the bag 10. Each of the indicia 18 is disposed on the outer surface, such that it is easily read after a food portion has been placed inside the bag 10. As illustrated in FIG. 1 each of the indicia 18 runs along the center line of the bag 10 and is comprised of the name of the weekday "MONDAY" in both English and Spanish. FIGS. 2 and 3 further show that the indicia 18 are imprinted on the outer surfaces of the bag 10 and that they form a continuous line around the outer surface of the bag 10. This provides for a quick and easy determination of the predetermined date from almost any viewing angle.

The indicia 18 are imprinted on the bag 10 to identify a predetermined date, such as the day of the week or the like, when the portion was formed. If the bags are made from a single sheet of plastic, a roll of plastic can be imprinted prior to formation of the plastic bag 10 and would thus, simplify manufacturing and reduce costs. In particular embodiments, the indicia 18 may comprise days of the weeks (i.e., as illustrated in the drawings), numbers corresponding to the weeks in a year, or the names of the months in the year. Each of the indicia 18 of a specific predetermined date may also correspond to and be associated with a different color from a plurality of colors that aids the user in quickly identifying the date on which the portion was formed and stored in the container. For example, in the preferred embodiment, Monday would be blue, Tuesday would be yellow, Wednesday would be red, Thursday would be brown, Friday would be green, Saturday would be orange and Sunday would be black.

As further illustrated in FIG. 1, each indicia 18 of a specific predetermined date may also be imprinted in more than one language. This would allow for easy identification by workers who use a variety of different languages. In the illustrated embodiment, the indicia 18 is imprinted in English and Spanish. It should be understood that the indicia 18 is not limited to just the combination of English and Spanish.

The illustrated embodiment shows an opaque plastic bag 10 to simplify the understanding of the drawings. However, the preferred embodiment uses a transparent plastic bag 10. When transparent plastic bags are used, the food portion serves as a background which makes the indicia 18 of predetermined dates more readily visible to the user.

The food inventory device may be formed using conventional manufacturing methods. For instance, the indicia 18 of the predetermined dates may be imprinted on the plastic by a printing device as the plastic is unrolled from a roll. It should be noted, however, that the indicia 18 could also be applied by a device, such as a printer or the like, when the plastic is initially formed and rolled onto a roll for later use or after a bag 10 has been formed from the plastic. Printing prior to the formation of the bag will allow for a more efficient manufacturing process. As the plastic is unrolled, it may be formed into a bag 10 using standard heat sealing techniques known in the industry. Once the bag is formed and the indicia 18 are on the bag, the portion inventory device is ready for use.

To use the food inventory device illustrated in FIGS. 1–3, a worker divides the food into at least one desired portion. Next, the user then determines the date (i.e., the current day of the week) that would be associated with the bag 10. For example, if the current day is Wednesday, a worker would select the bag 10 marked "WEDNESDAY". Once the proper bag is selected, the user places at least one portion in the bag 10. Finally, the user closes the bag 10 and stores it in a proper location to maintain freshness. As is clearly shown by this example, the user does not need to mark the bags or apply adhesive dots which have been marked.

To retrieve a stored portion in the proper order, the user retrieves previously stored portions from the bags which indicate that the contained portions have been stored for the longest period of time. From the above example, the user might pull out week old portions labeled "THURSDAY". The bags are easily identified by the indicia 18. Further, it is apparent that the imprinted indicia cannot fall off during storage.

It should be understood that a container other than a bag 10 may be used in the present invention. For example, a box, a stackable container with a lid or the like may be used. These containers may be used as long as they are capable of imprinting, for example, with indicia of a predetermined date. Moreover, the device of the present invention is not limited to use with food portions. For instance, the bags could be used with other perishables such as flowers or it may be used with parts for projects to be performed, for example, on specific days of the week.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A restaurant inventory control system comprising a plurality of sets of seven different resilient bags, each of said seven different bags having imprinted directly on an outer surface thereof indicia in a different selected color, on each of said bags, wherein said indicia consist of a weekday name, and wherein each of said seven bags has a different weekday name.

2. The inventory control system of claim 1 wherein each bag has a weekday name in English and in Spanish.

3. The inventory control system of claim 2 wherein said weekday names are arranged linearly and wherein said weekday name in English and Spanish are both disposed within a printed box.

4. The inventory control system of claim 3 wherein said weekday names in English and Spanish are repeated on the same outer surface of each of said bags at least twice.

5. The inventory control system of claim 2 wherein said indicia are repeated on said outer surface of each of said bags at least twice.

6. The inventory control system of claim 2 wherein the weekday name in English is printed above the weekday name in Spanish.

* * * * *